US009080733B2

(12) United States Patent
Rowley et al.

(10) Patent No.: US 9,080,733 B2
(45) Date of Patent: Jul. 14, 2015

(54) METHOD OF MAKING AN LED LAMP

(71) Applicant: LED Waves, Inc., Brooklyn, NY (US)

(72) Inventors: Larry W. Rowley, Daniels, WV (US); Joel Slavis, New York, NY (US)

(73) Assignee: LED Waves, Inc., New York, NY (US)

( * ) Notice: Subject to any disclaimer, the term of this patent is extended or adjusted under 35 U.S.C. 154(b) by 139 days.

(21) Appl. No.: 14/051,653

(22) Filed: Oct. 11, 2013

(65) Prior Publication Data

US 2015/0103525 A1 Apr. 16, 2015

(51) Int. Cl.
*F21V 29/00* (2015.01)
*F21K 99/00* (2010.01)

(52) U.S. Cl.
CPC ... *F21K 9/90* (2013.01); *F21K 9/30* (2013.01); *F21V 29/22* (2013.01)

(58) Field of Classification Search
CPC ..... F21V 29/002; F21V 29/507; F21V 29/89; F21V 29/22; H01L 33/64; F21K 9/90; F21K 9/30
USPC ..... 362/249.06, 650, 249.02
See application file for complete search history.

(56) References Cited

U.S. PATENT DOCUMENTS

| | | | | |
|---|---|---|---|---|
| 5,688,042 | A | 11/1997 | Madadi et al. | |
| 5,890,794 | A | 4/1999 | Abtahi et al. | |
| 6,848,819 | B1 | 2/2005 | Arndt et al. | |
| 7,674,016 | B2 | 3/2010 | Zhang et al. | |
| 2005/0269581 | A1* | 12/2005 | Dry | 257/88 |

* cited by examiner

*Primary Examiner* — Sharon Payne
(74) *Attorney, Agent, or Firm* — Louis Ventre, Jr.

(57) ABSTRACT

A method of making a light emitting diode (LED) lamp is disclosed. Included are steps of: providing a metal heat sink having a cylindrical portion formed with flat planar surfaces extending longitudinally around the outer surface; providing flat LED boards that are attached to the flat planar surfaces; providing a circular LED board mounted to the top end of the cylindrical portion; providing a turret connector board with electrical connection ports to electrically join the LED boards; providing a driver circuit board and electrically connecting it to the turret connector board; connecting the flat LED boards to the driver circuit board; securing the circular LED board to the top open-end; and securing the flat LED boards to the flat planar surfaces. Optional steps include: providing a mounting plate of heat conducting metal; applying thermal compound; providing and installing a transparent cover; providing and attaching a mount to the incandescent lamp.

7 Claims, 9 Drawing Sheets

METHOD OF MAKING AN LED LAMP

TECHNICAL FIELD

In the field of illumination, a method of making a high-intensity light emitting diode (LED) luminaire that greatly improves heat dissipation using a solid base of metal and in a configuration that enables significant additional light emission from LED chips.

BACKGROUND ART

The present invention has application where high intensity, long-life lighting is needed. Typical uses may include an indoor or outdoor application, a wet location, a hazardous location, and a waterproof location. The invention has application to commercial, residential, retail and industrial applications in general, in both wet locations and dry locations.

LED chips enable greater lamp life. The present invention is suitable for retrofit and replacement applications using differing mounts. Such application enables LED use where traditional lighting was previously employed, either indoors, where the LED lamp may be used for replacement of a standard light bulb, such as an A-19 type light bulb also known as general service lamp, or for a replacement of compact fluorescent lamp (CFL). Compact fluorescent lighting applications use a protective case when waterproofing in hazardous or wet locations is involved. No protective case is used in standard applications involving residential/commercial/industrial CFL units. The design of the present invention enables a direct retrofit via simple removal of the compact fluorescent lamp holder and use of the LED lamp with the mounting plate. Thus, the LED lamp disclosed herein is a direct retrofit for almost any lamp on the market.

Stationary lamps are those affixed to a structure and are typically used in hard to maintain locations where their operation for safety purposes or in the event of an accident is of prime importance. However, the LED lamp disclosed has a general service application applying to residential, commercial, industrial and other applications.

Other examples of hard to maintain locations are beacon lights installed within waterways marking navigational hazards, such as rock formations, docking facilities, and buoy locations. When safety, reliability after accident conditions, and lighting intensity can be improved along with reduced maintenance and increased lifetime, these attributes are highly sought out and implemented quickly.

Previously, LED lighting for such uses has been minimal or even disfavored because LED lights in such applications were low intensity dictated by the inherent difficulties in removing heat in a water tight enclosure needed for such uses. Today, when lighting is needed for these applications, the preferred choice has been among incandescent lamps, low-pressure and high-pressure sodium vapor lamps and fluorescent lamps. While heretofore considered necessary, such lighting is a high-operating and high-maintenance option due to the high current required and the frequent need for replacing burned-out bulbs.

SUMMARY OF INVENTION

A method of making a light emitting diode (LED) lamp is disclosed employing a step of providing a metal heat sink having a cylindrical portion formed with flat planar surfaces extending longitudinally around the outer surface. The heat sink has a base portion with a flange attached to the bottom end of the cylinder portion. The heat sink has a top open-end.

The method includes a step of providing flat LED boards that are attached to the flat planar surfaces. The method includes a step of providing a circular LED board mounted to the top end of the cylindrical portion. The method includes a step of providing a turret connector board with electrical connection ports to electrically connect the LED boards. The circular LED board fits within the chamber. The method includes the step of providing a driver circuit board and electrically connecting it to the turret connector board. The method includes steps of connecting the flat LED boards to the driver circuit board; securing the circular LED board to the top open-end; and securing the flat LED boards to the flat planar surfaces. Optional steps include providing a top plate covering the top open end, the top plate defining a wire-hole providing access to the chamber; providing a mounting plate of heat conducting metal configured to couple the flange to a lamp fixture; applying thermal compound between the LED boards and the heat sink; providing a transparent cover for the cylindrical portion; installing the transparent cover over the cylindrical portion; providing a mount to backfit an incandescent lamp and attaching the mount to the incandescent lamp. Included is the light emitting diode lamp made by the method described.

TECHNICAL PROBLEM

A low-operating cost, high intensity LED lamp for commercial residential and industrial uses is presently unattainable because the heat produced by existing luminaire designs causes premature lamp failure.

Heat generation and thermal stressing of LED circuits can quickly lead to efficiency loss and diminished lumens-per-watt output, affecting brightness. Too much thermal stress leads to lamp failure due to circuit breakdown with soldered joint failure and epoxy failure. Lens clouding or yellowing also occurs when there is too much heat and too little heat transfer away from the LED's. Thus, there is an urgent need for a high-intensity luminaire design providing fully operational heat management capability that minimizes or avoids these system failure mechanisms.

Fluorescent luminaires provide more light than incandescent bulbs, but usually after a warm-up period of about 30 minutes. After that period, fluorescent light levels can be twice as great as initial levels. High output and super high output fluorescent lamps are also available. The rated life of typical fluorescent lamps in some applications range from 7,500 to 20,000 hours. Because of higher cost and surface intensity (which may require more diffusion), lower efficacy and lamp life, and greater lumen depreciation, high output and super high output lamps are applied only in instances where high-lumen output is necessary and achievement of design objectives through use of additional luminaires is undesirable. In these situations, there is presently no application-safe high-intensity LED lamp that could satisfy design objectives for more light, longer life, and maximal output upon initial activation.

Existing luminaires (fluorescent, high-pressure sodium, mercury vapor, and incandescent, especially incandescent) can vary illumination widely with line voltage deviations from nominal. This is a problem for some self-propelled machines. Illumination may either be mounted on the machine or may be separate from the machine, for example, temporarily mounting them along roof and ribs. In either case, more than sufficient lighting is can improve safety because this is where machine-worker activity is most concentrated and hazards are most serious and most likely to develop.

For all existing luminaire options, the amount of light energy emitted by a lamp typically diminishes significantly over the course of its service life. For example, high-intensity discharge lamps and mercury vapor lamps are said to dissipate by 45 percent.

Presently, the predominant high-intensity-discharge lamp types that are used include high-pressure sodium and mercury vapor lamps as well as other types such as the various metal halide lamps. These lamp types are expensive, sensitive to voltage variations, can flicker in light output, and can shatter upon failure.

There are presently no luminaire options providing a rugged high intensity LED lighting system. Long life, low maintenance requirements, and rugged service are long sought and needed to reduce costs in many applications.

Evidence shows that total lamp associated-costs can be very high in many applications. Typical rated service life for incandescent lamps is about 1,000 to 2000 hours. Although this is a fraction of the rated service life for gas discharge (fluorescent, mercury vapor, and high-pressure sodium) lamps, the actual realized life differential may be much less in some rugged applications. Longer life high intensity LED luminaire options are not now available but would be considered important in reducing maintenance costs in many applications.

Compact fluorescent lamps in indoor applications inherently run very hot because of the inherent nature of all the energy powering the lamp and the heat conducted away from the lamp runs through a very small point at the base of the lamp. The same is true for a standard general service lamp, a Hydrargyrum quartz iodide (HQI) mercury halide lamp, and a sodium vapor lamp. This design feature restricts the potential applications for high intensity lighting and presents problems for environmental control, lamp life and potential accidental combustion.

The typical mercury halide and sodium vapor type lamps are usually installed in very high areas, making it very difficult to replace and adding to maintenance costs. Also, maintenance errors are common when a contractor replaces a lamp with the wrong color temperature creating disparity of color in the room or area that's being lighted.

SOLUTION TO PROBLEM

The solution is a high-intensity LED lamp that solves the problems of heat removal while using much less electrical energy than an incandescent lamp. The LED lamp is unique at least in part because the heat sink design greatly increases conductive heat flow from the LED lights, eliminating the bottleneck of existing incandescent lamps that convey heat through a single point at the base of such lamps. The LED lamp changes that single point heat conductor to a lamp where the virtually the whole metal body of the lamp becomes a conductive means to convey heat away from the lights to the base of the lamp where a comparatively large area of heat conducting metal greatly increases removal of heat. Heat is conducted not through a single point at the base of the lamp, but rather through a comparatively very large metal surface area at the base of the lamp. This high heat removal design enables for the first time, the use of high-intensity LED lighting in applications traditionally served by incandescent and other lighting options.

ADVANTAGEOUS EFFECTS OF INVENTION

The solid state LED luminaire, also referred to as a high-intensity LED luminaire and high-intensity LED lamp, removes the typical small heat-dissipation-area from virtually all standard lighting and replaces it with a large heat-dissipation-area created by a relatively large plate. Solving this problem creates new luminaire applications for residential and industrial operations, and for retail businesses such as original equipment manufacturers of industrial and commercial machinery.

The solid state LED luminaire delivers a high-intensity, low-electricity using LED luminaire with greater-performance for heat removal than existing solutions. It solves the single biggest problem with LED lamps as well as traditional lamps, which is a heat dissipation problem.

In typical applications, the high-intensity LED luminaire provides fully adequate heat removal and that is expected to last up to 100 times longer than incandescent lamps.

The high-intensity LED luminaire reduces hazards, especially when persons or objects in a workers' peripheral field of vision, can be more readily detected.

The high-intensity LED luminaire has a back-fit design for use with existing incandescent fixtures. By using a mounting plate, the LED lamp disclosed herein is a replacement for retrofit or substitute for the current lamp holder that the fixture is using. For example, in the cases of a general service lamp, it is practical to take an E 26 lamp holder or a CFL lamp holder and replace it with the mounting plate described herein, which allows the fixture to be retrofitted with the LED lamp disclosed herein. The same is true for a mobile base unit. The high-intensity LED luminaire, thus, minimizes installation costs and improves component service life.

The solid state LED luminaire is inherently shock and vibration resistant and suitable for rugged installations as well as everyday applications.

Any application where there is a need for lamps that exceed minimum lumination requirements. The present invention can provide a high-intensity LED lamp that greatly exceeds minimum lumination standards with unparalleled longevity.

The high-intensity LED lamp can replace the lamp holder of the standard CFL, or standard general service lamp, or HQI, mercury halide, sodium vapor lamp, with a relatively huge base plate to dissipate the heat over a much greater area. This avoids the problem found in standard lighting in having all the heat going through one point.

The high-intensity LED lamp can be used as a replacement lamp, which can avoid the increased maintenance costs and potential color disparities from replacing mercury halide, and sodium vapor type lamps with the wrong color temperature mercury halide and sodium vapor lamps.

The high-intensity LED lamp can replace a compact fluorescent lamp socket, a general service lamp, a mercury halide sodium vapor lamp, or hydrargyrum quartz iodide type of lamp in an indoor or outdoor location. These replacement applications are enabled by changing the base plate on the high-intensity LED lamp.

The high-intensity LED lamp has universal application to general household lighting, retail lighting, commercial lighting, hotels, restaurants, and on and on. It can be readily applied to any existing standard lamp holder, such as mercury vapor, compact fluorescent lamp, standard general lighting, spotlighting lamps, and anywhere there is a generic type of lamp holder.

BRIEF DESCRIPTION OF DRAWINGS

The drawings illustrate preferred embodiments of the method of the invention and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention. For example, the steps in the method of the invention may be performed in any order that results making or using the luminaire described herein.

Figure 1:
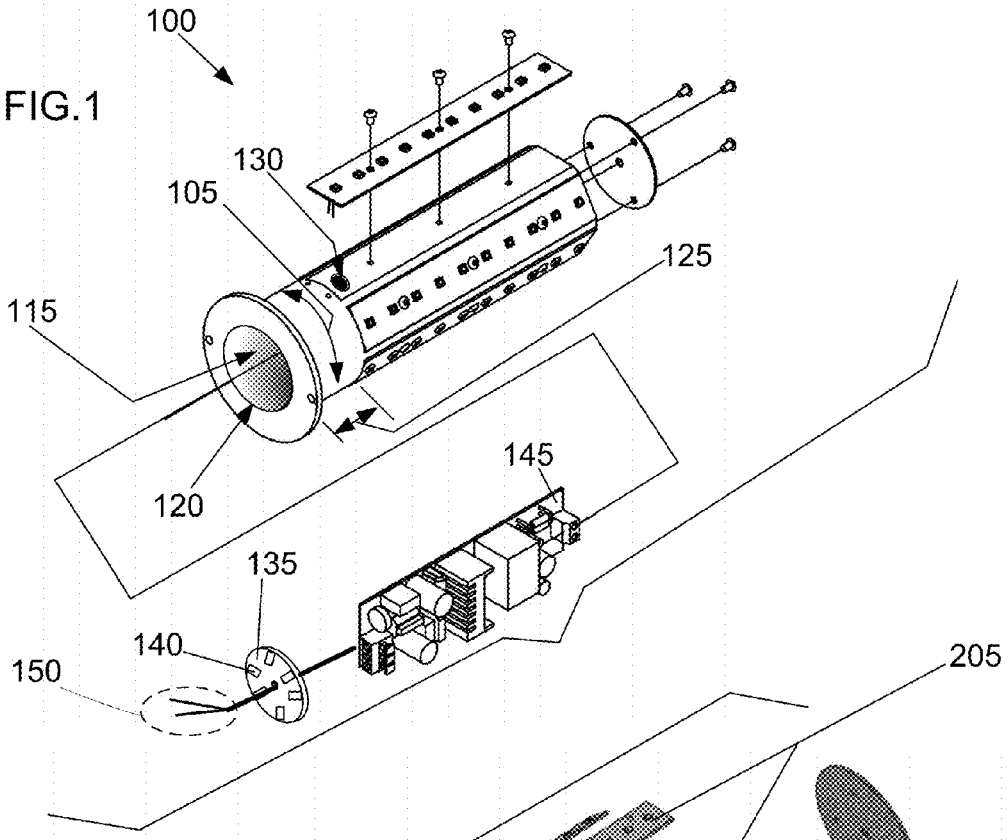
FIG. 1 is an exploded perspective view of a luminaire having a heat sink with six flat planar surfaces and a driver circuit fitting within a chamber of the cylindrical portion of the heat sink.

FIG. 1 is an exploded perspective view of an exemplary light emitting diode (LED) lamp (100), also referred to herein as a luminaire. The light emitting diode (LED) lamp (100) has a heat sink (400), a driver circuit board (145), flat LED boards (205), a circular LED board (620), and a turret connector board (135).

The heat sink (400) is made of a heat conducting metal, preferably aluminum or aluminum alloy. All of the components of the heat sink (400) are preferably made of the same heat conducting metal.

Figure 2:
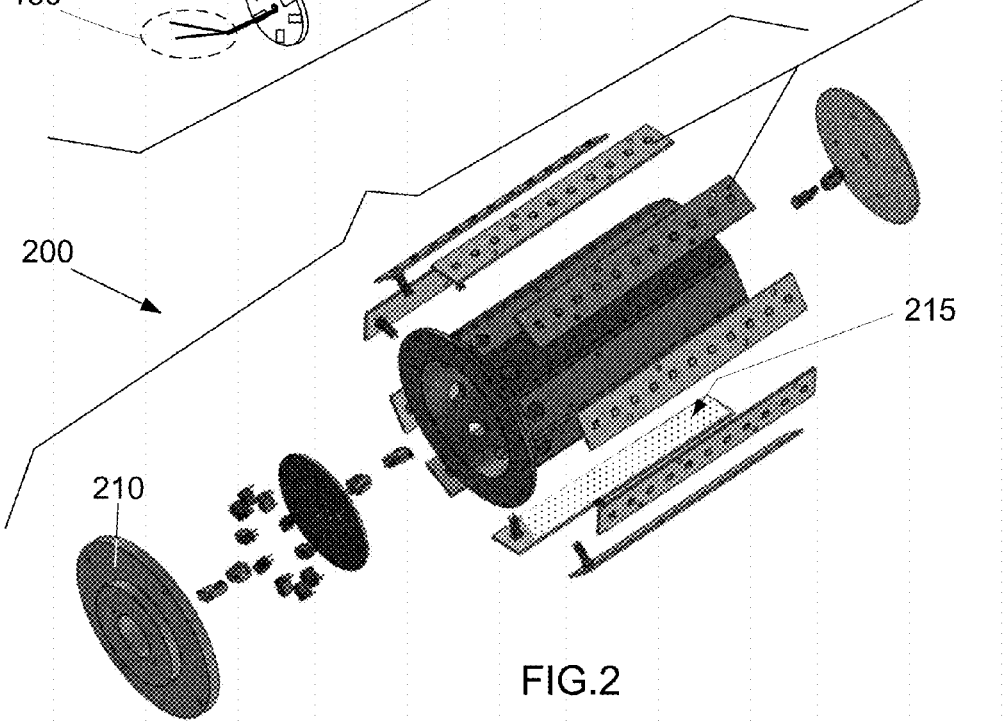
FIG. 2 is an exploded perspective view of another embodiment of the luminaire having a heat sink with ten flat planar surfaces where the driver circuit would be mounted externally to the heat sink.
Figure 3:
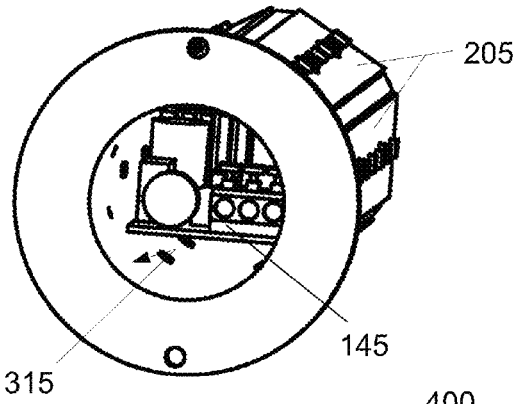
FIG. 3 is a bottom end perspective of an assembled heat sink showing the driver within the chamber and showing the flat LED boards attached to the flat planar surfaces.
Figure 4:
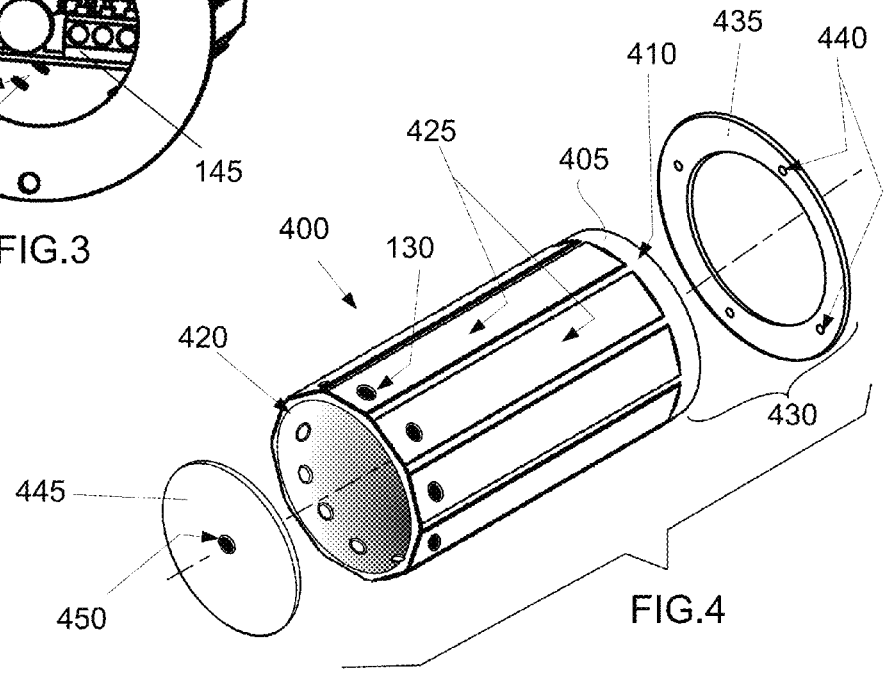
FIG. 4 is an exploded view of the heat sink with ten flat planar surfaces showing the cylindrical portion, flange, top open-end and electrical access ports.
Figure 5:
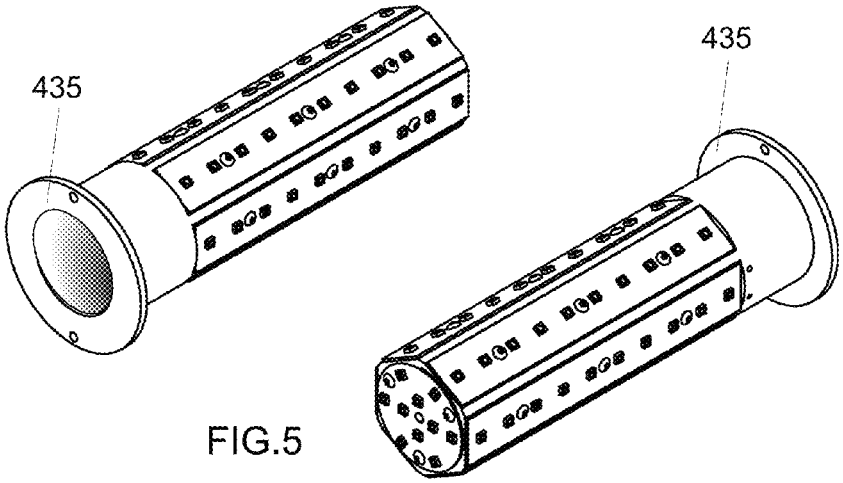
FIG. 5 shows perspective views of the heat sink with six flat planar surfaces with flat LED boards attached and further showing the flange at the bottom open-end and the circular LED board attached at the opposing or top end.
Figure 6:
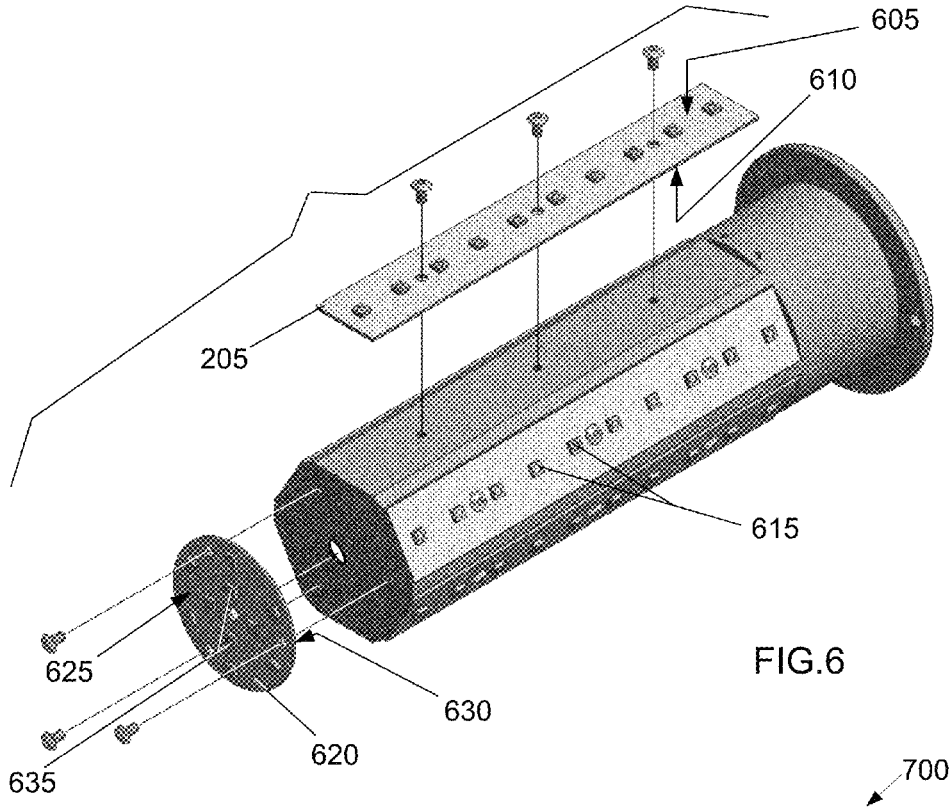
FIG. 6 is an exploded and shaded perspective view of the heat sink showing the flat planar surfaces, flat LED boards and circular LED board.

The heat sink (400) has a plurality of flat planar surfaces (425) on the cylindrical portion (405). One preferable embodiment is shown in FIG. 1 having 6 flat planar surfaces. A preferable second embodiment (200) is shown in FIG. 2 having 10 flat planar surfaces. Other embodiments may have fewer or more flat planar surfaces than those shown in FIG. 1 and FIG. 2, respectively. The number of flat planar surfaces in the plurality of flat planar surfaces (425) on the cylindrical portion (405) of the heat sink (400) may vary as long as there is more than one such flat planar surface.

Thus the embodiments represented by FIG. 1 and FIG. 2 are two exemplary preferred embodiments with the primary difference being that the FIG. 1 embodiment is smaller in size with fewer LED lights than the FIG. 2 embodiment. Because there are fewer LED lights, the heat generated in the FIG. 1 embodiment is necessarily less than that of the FIG. 2 embodiment. For such lower heat-producing, smaller versions, as illustrated by FIG. 1, the driver circuit board (145) is preferably located within the chamber (115) of the heat sink (400), but it may be located outside the chamber (115) for any application. For the larger embodiments, such as the one shown in FIG. 2, it is preferable, although not required, that the driver circuit board (145) be located away from the heat sink and is preferably not located within the chamber (115), but it may be located within the chamber (115) for a suitable application.

The method of making the light emitting diode (LED) lamp (100) includes a step of providing a heat sink (400) made of heat conducting metal and having a cylindrical portion (405), a base portion (430); a flange (435) at the bottom end of the cylindrical portion (405) and a top open-end (420) at the top end of the cylindrical portion (405). Because heat transfer is chiefly through conduction, there are no fins used in a preferred heat sink. In all cases, the heat sink (400) may be molded as one piece, rather than considered an assembly of separate portions or parts.

The cylindrical portion (405) of the heat sink (400) is preferably a body having a right-circular cylindrical shape that is tubular with a length longer than its outer diameter. Such a body typically has circular bases or ends, but these may be ellipses, squares, pentagons or other shapes in other embodiments. As with any pipe or tube, the cylindrical portion (405) has an outer surface (410) that defines a periphery (105) along the length of the cylindrical portion (405). The periphery (105) defines the external boundary or surface of the cylindrical portion (405) along its length and is preferably smooth, but may be irregular.

As with any pipe or tube, the cylindrical portion (405) has an inner surface (315) defining a limit to a chamber (115) within the cylindrical portion (405). The chamber (115) is defined by the volume within the cylindrical portion (405).

The cylindrical portion (405) has a bottom open-end (120) and a top open-end (420). The cylindrical portion (405) is formed with a plurality of flat planar surfaces (425) extending longitudinally around the outer surface (410) from the top open-end (420) to a distance (125) above the bottom open-end (120). Preferably, the flat planar surfaces extend over most of the length of the cylindrical portion (405). The flat planar surfaces may be formed by milling, casting or other method when the cylindrical portion is made.

Preferably, holes or ports are drilled in each of the flat planar surfaces for screws and to enable electrical connection to flat LED boards (205) that are attached thereto. The primary reason for a screwed, mechanical connection is to promote heat dissipation.

Electrical connection holes are drilled through the wall of the cylindrical portion (405) to enable electrical connection and interconnection of the LED boards. Preferably there is one flat LED board for one flat planar surface. Thus, each flat planar surface in the plurality of flat planar surfaces (425) defines an electrical access port (130) to the chamber (115). The electrical access port (130) may be located at any convenient location on the flat planar surface.

The heat sink (400) has a base portion (430) that includes a flange (435) attached to the bottom open-end (120) of the cylindrical portion (405). The flange (435) defines at least two bolt holes (440) that are accessible beyond the periphery (105) of the cylindrical portion (405) so that the LED lamp can be secured to a retrofit mount, a mounting plate or other attachment surface of a lighting fixture.

Figure 11:
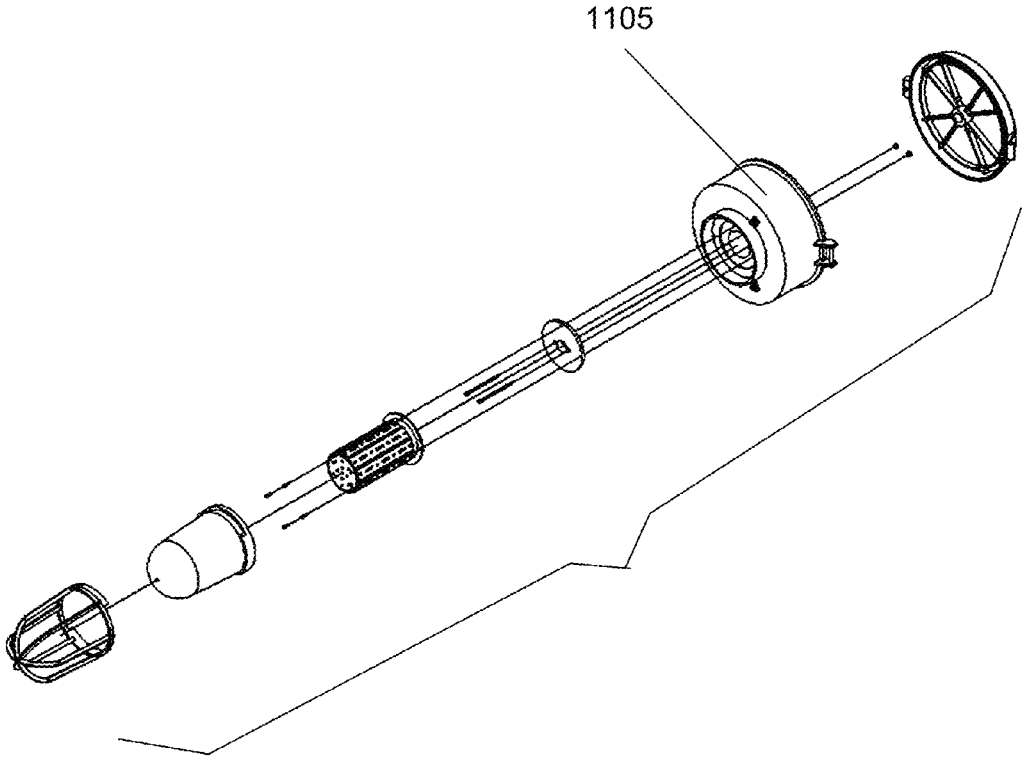
FIG. 11 is an exploded view of an LED lamp within a lamp fixture formerly housing an incandescent bulb or a compact fluorescent lamp.
Figure 12:
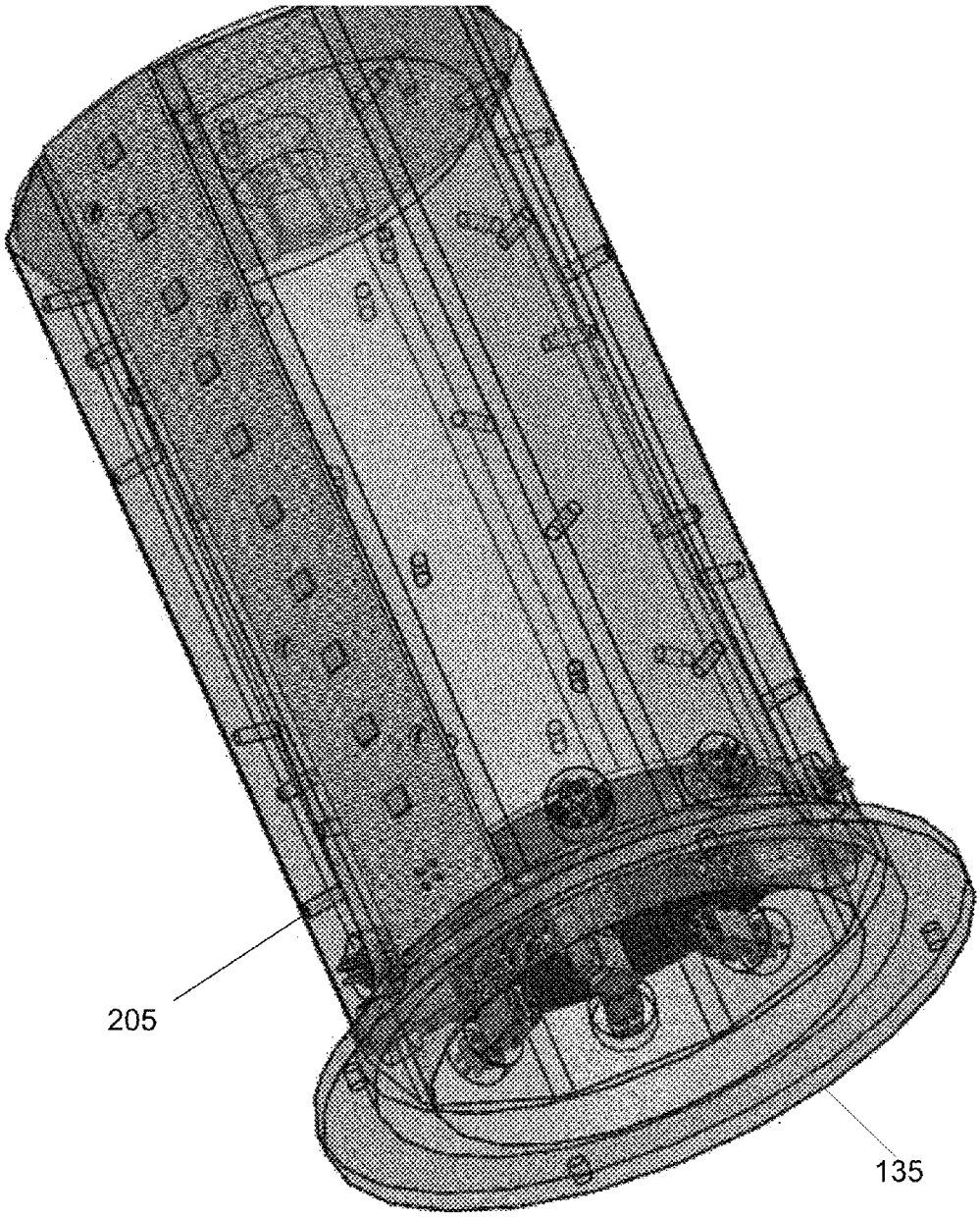
FIG. 12 is a transparent perspective of the LED lamp showing one flat LED board connected to the turret connector board within the chamber.

Thus, the method of making a light emitting diode (LED) lamp (100) may include the step of providing a mounting plate (210) of heat conducting metal configured to couple the flange (435) to a lamp fixture (1105), as shown in FIG. 11. For example, the lamp fixture (1105) shown in FIG. 11 could be for a standard incandescent bulb, a compact fluorescent lamp, or a mogul E-40 light low-pressure or high-pressure Mercury sodium type. The mounting plate (210) provides direct physical contact between the light emitting diode (LED) lamp (100) and surface of the ceiling, or whatever the old fixture was mounted to. This serves a purpose for the mounting plate to meld the light emitting diode (LED) lamp (100) to the existing electrical box as well as provide excellent heat dissipation.

Figure 8:
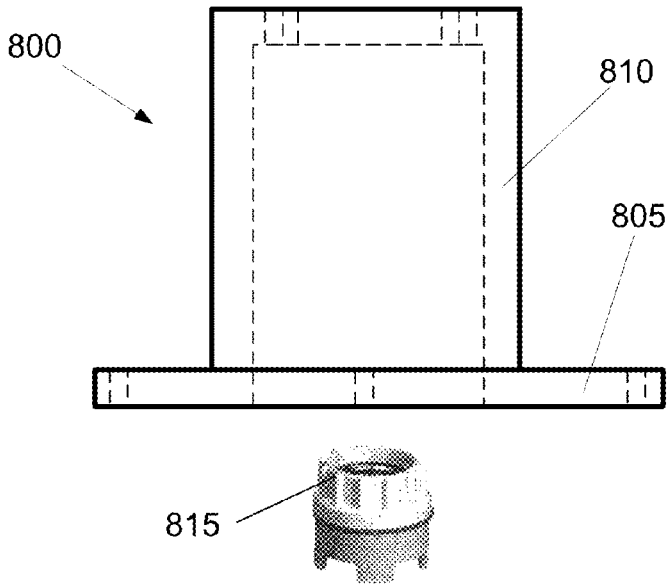
FIG. 8 is an elevation view of a mount to enable use of the LED lamp to fit over an incandescent socket.
Figure 9:
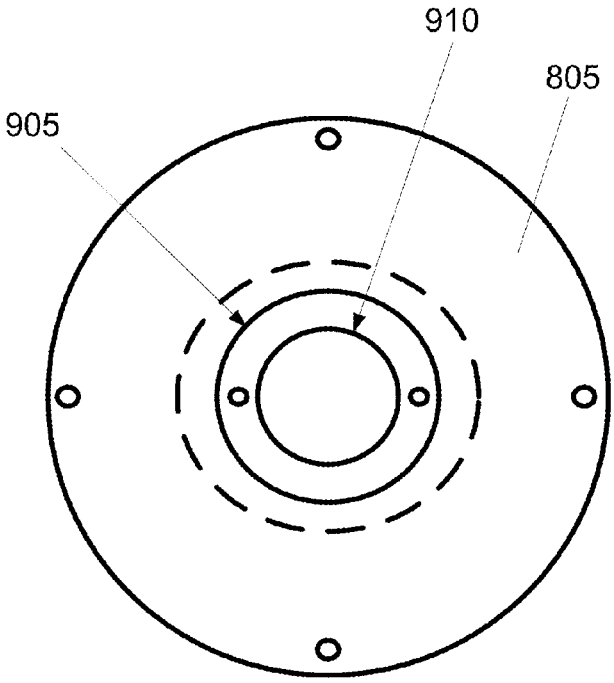
FIG. 9 is a bottom end view of the mount shown in FIG. 8.

FIG. 8 shows another optional mount for the light emitting diode (LED) lamp (100). FIG. 9 is a bottom end view of the mount without the lighting socket (815) shown in FIG. 8. Thus, the method of making a light emitting diode (LED) lamp (100) may further include the steps of: providing a mount (800) to backfit an incandescent lamp or a compact fluorescent lamp, the mount (800) comprising an annular disk (805) having a central hole (905) surrounded by a right circular cylinder (810) rising from the disk and defining an access opening (910) at the top of the right circular cylinder (810), the access opening being of sufficient size to enable access to an lighting socket (815) placed within the right circular cylinder (810); and attaching the mount (800) to the incandescent lamp or the compact fluorescent lamp so as to place the lighting socket (815) within the right circular cylinder (810).

The heat sink (400) has a top open-end (420) of the cylindrical portion (405). Optionally, a top plate (445) covers the top open-end (420), the top plate (445) defining a wire-hole (450) providing access to the chamber (115). In an alternative embodiment, the top plate is molded as one piece with the cylindrical portion (405) and the flange (435).

The method of making a light emitting diode (LED) lamp (100) further comprises the step of providing flat LED boards (205), which will be attached to the plurality of flat planar surfaces (425). Each flat LED board has an illuminating surface (605) and an attachment surface (610).

The illuminating surface (605) holds a plurality of LED lights (615) and faces outward from the heat sink (400). Thus, plurality of LED lights (615) is mounted for illumination on the illuminating surface (605). There are preferably 10 LED lights on each flat LED board, but there may be more or less depending on the lighting application.

The attachment surface (610) of a flat LED board is in conductive contact with a flat planar surface of the heat sink (400). Such conductive contact is either direct physical contact or indirect contact, such as through a thermal compound (215) to improve conductive heat transfer. A preferred thermal compound is a high-density polysynthetic silver thermal compound and a brand name example is ARCTIC SILVER. Thus, the method of making a light emitting diode (LED) lamp (100) may include steps of applying thermal compound (215) between each attachment surface (610) and each flat planar surface, and applying thermal compound (215) between the second attachment surface (630) and the top plate (445). A thermal pad is an equivalent suitable alternative to the thermal compound and may be used instead or in combination with thermal compound in some applications.

Each flat LED board is configured such that the attachment surface (610) fits on one flat planar surface in the plurality of flat planar surfaces (425) on the cylindrical portion (405). Preferably, the entire attachment surface of a flat LED board is in conductive contact with a flat planar surface on the heat sink (400). Thus, the method of making a light emitting diode (LED) lamp (100) further comprises the step of securing the flat LED boards (205) to the plurality of flat planar surfaces (425) such that there is one attachment surface (610) for each flat planar surface in the plurality of flat planar surfaces (425).

The method of making a light emitting diode (LED) lamp (100) further comprises the step of providing a circular LED board (620), which is mounted to the top end of the heat sink (400) over the top open-end (420), or over the top plate (445), when the top plate (445) is present. The circular LED board (620) is configured such that the attachment surface (610) fits on the top open-end (420), or on the top plate (445) when present. The wire-hole (450) in the top plate (445) provides access to the chamber (115) where circular LED board (620) is electrically connected or interconnected with the flat LED boards (205). The circular LED board (620) comprises a second illuminating surface (625), a second attachment surface (630), and a second plurality of LED lights (635) mounted for illumination from the second illuminating surface (625). Thus, the method of making a light emitting diode (LED) lamp (100) further comprises the step of securing the circular LED board (620) to the top open-end (420).

Figure 7:
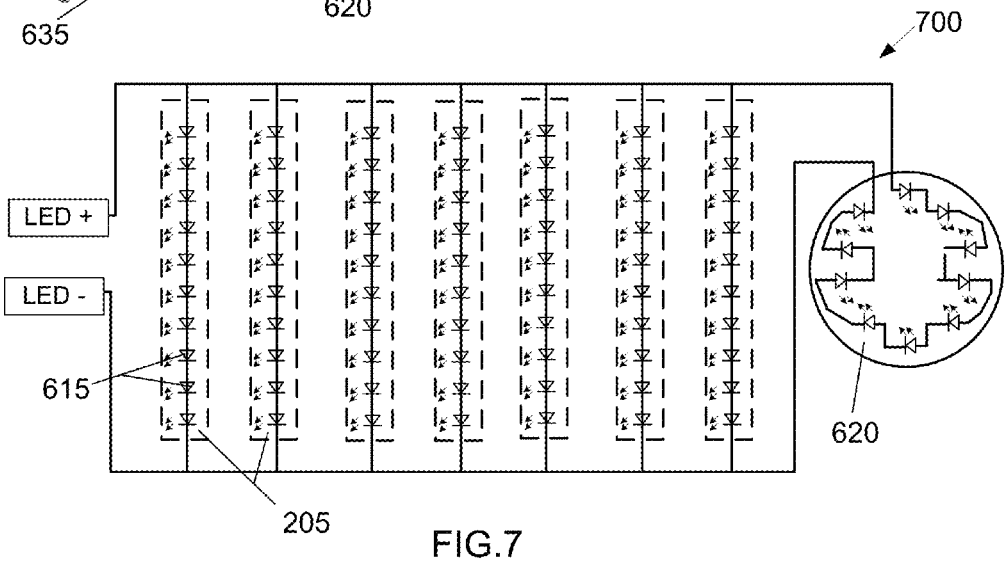
FIG. 7 is a schematic of the electrical connections for the flat LED boards and circular LED board.
Figure 13:
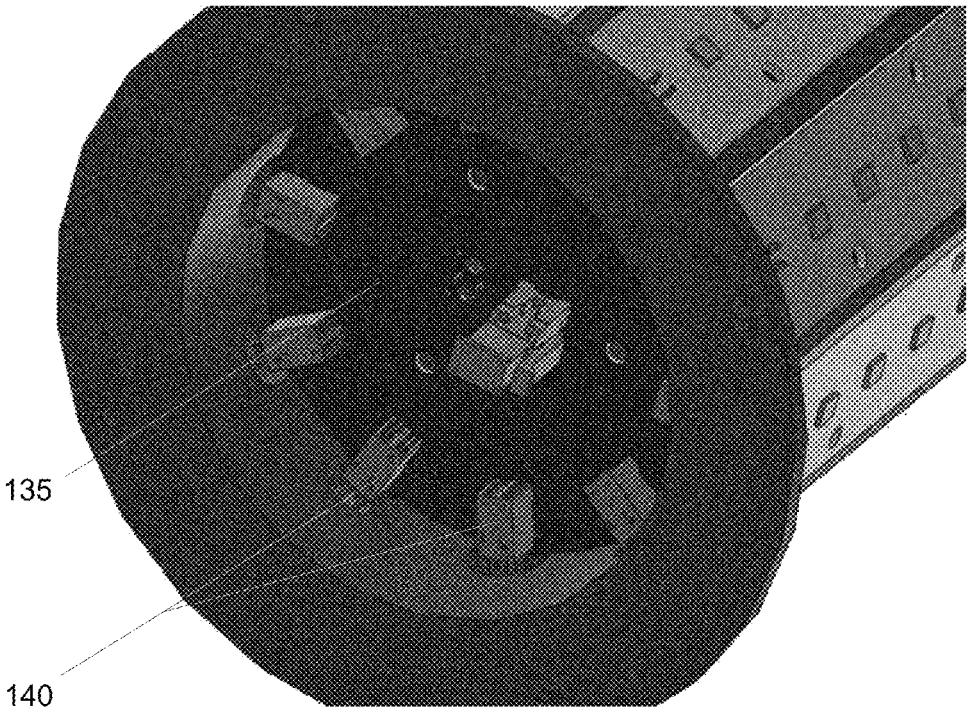
FIG. 13 is a shaded perspective of the bottom end of the LED lamp showing the flange and the turret connector board in the chamber connecting to the flat LED boards.
Figure 14:
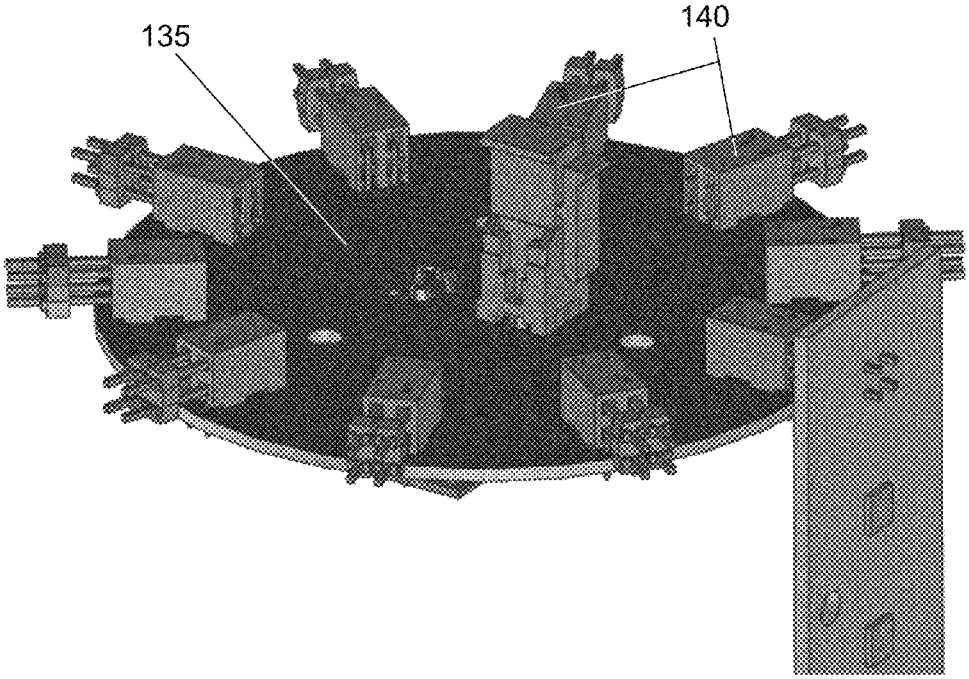
FIG. 14 is a shaded perspective of the turret connector board connected to a single flat LED board in the absence of the heat sink.
Figure 15:
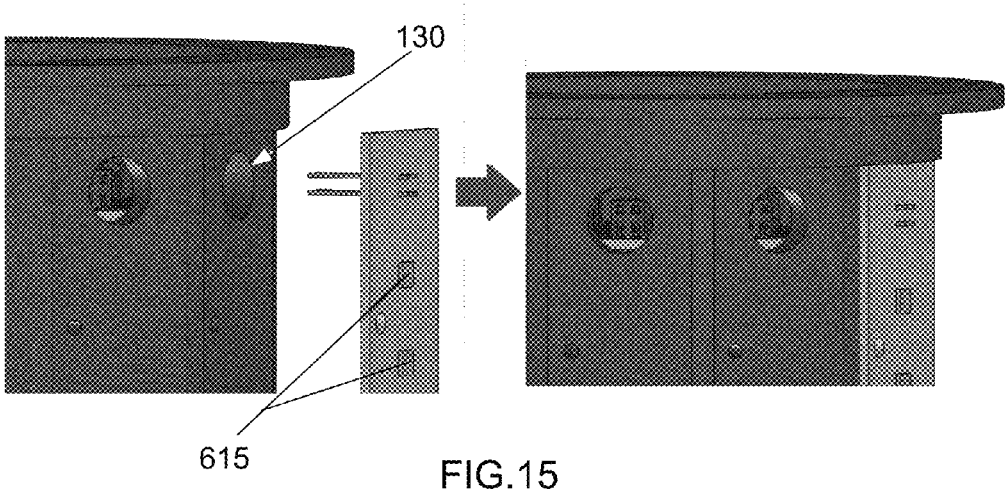
FIG. 15 shows two shaded elevation views illustrating how 4 pins on the flat LED board are inserted into female plugs on the turret connector board to create the electrical connections.

The method of making a light emitting diode (LED) lamp (100) further comprises the step of providing a turret connector board (135), which is the preferred means to electrically interconnect all of the LED boards together. FIG. 7 is a schematic (700) of the preferred electrical connections for the flat LED boards (205) and circular LED board (620). As can be seen, all of the LED boards are connected together in parallel and this is preferably done through the turret connector board (135), shown in more detail in FIG. 13 and FIG. 14. The schematic (700) also shows that the LED lights in the plurality of LED lights (615) on each flat LED board and the second plurality of LED lights (635) on the circular LED board (620) are connected to each other together in series. In an alternative embodiment, all of the LED boards are connected together in series. In yet another alternative embodiment, the LED lights are connected in parallel.

The turret connector board (135) comprises a plurality of electrical connection ports (140), where there is at least one electrical connection port for each flat LED board and for the circular LED board (620).

Thus, the turret connector board (135) is configured to electrically connect each flat LED board and the circular LED board (620) in parallel when each flat LED board and the circular LED board (620) are connected using the plurality of electrical connection ports (140). The turret connector board (135) is sized to fit within the chamber (115). Electrical connection of some or all of the LED boards in series is a potential alternative embodiment.

The method of making a light emitting diode (LED) lamp (100) further comprises the step of providing a driver circuit board (145) that is electrically connected to the turret connector board (135). Preferably, MOLEX connectors are used to connect the LED boards to the turret connector board (135) and the driver circuit board (145) to the turret connector board (135). Thus, the method of making a light emitting diode (LED) lamp (100) further comprises the steps of connecting the circular LED board (620) to the driver circuit board (145) and connecting the flat LED boards (205) to the driver circuit board (145). In order to power the lamp, the driver circuit board (145) is connected to electricity supply wires (150).

When the driver circuit board (145) is placed within the chamber (115), the method of making the light emitting diode (LED) lamp (100) may optionally include steps of: installing a cushion within the chamber (115); and installing the driver circuit within the chamber (115) braced in place the cushion. The cushion is a material wedge to minimize movement of the driver circuit board (145) when it is within the chamber (115). Suitable cushions are preferably made of oil-resistant, neopreneninyl/buna-n foam rubber suitable for use in a closed cell in a temperature range of −40 degrees Fahrenheit to 200 degrees Fahrenheit.

Figure 10:
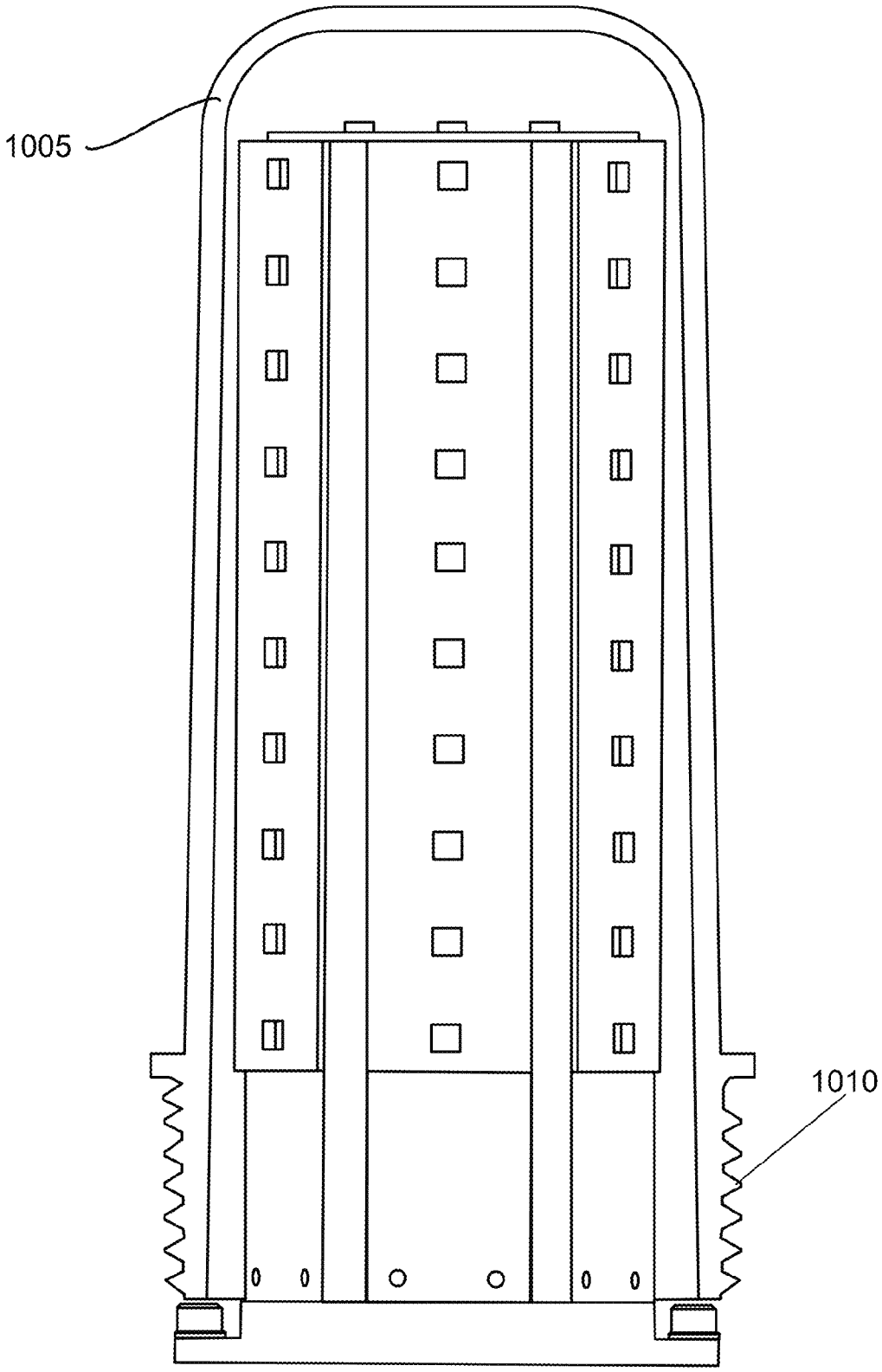
FIG. 10 is an elevation view of the LED lamp with a transparent cover.

The method of making a light emitting diode (LED) lamp (100) may include a step of providing a transparent cover (1005), as shown in FIG. 10. FIG. 10 is an embodiment that would preferably be used to replace a compact fluorescent lamp, a standard service incandescent lamp and a low-pressure or high-pressure Mercury vapor type of lamps.

The transparent cover (1005) is configured to extend over the cylindrical portion (405) and seal against the base portion (430) of the heat sink (400). The transparent cover (1005) preferably defines external threads (1010) extending adjacent to the flange (435) up to the flat planar surfaces so that the lamp can be screwed into a lighting fixture commonly found in luminaire applications. Thus, the method of making a light emitting diode (LED) lamp (100) may further include a step of installing the transparent cover (1005) over the cylindrical portion (405) of the heat sink (400).

The light emitting diode (LED) lamp (100) that is made by the methods described above is a unique product capable for the first time to permit high intensity LED light in a lamp where heat is removed principally by conduction.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the lighting industry.

What is claimed is:

1. A method of making a light emitting diode (LED) lamp, the method comprising the steps of:

providing a heat sink, the heat sink comprising a heat conducting metal, the heat sink further comprising;

a cylindrical portion;

the cylindrical portion comprising:

an outer surface, the outer surface defining a periphery of the cylindrical portion;

an inner surface defining a limit to a chamber within the cylindrical portion;

a bottom open-end;

a top open-end;

the cylindrical portion formed with a plurality of flat planar surfaces extending longitudinally around the outer surface from the top open-end to a distance above the bottom open-end;

each flat planar surface in the plurality of flat planar surfaces defining an electrical access port to the chamber; and a base portion, the base portion comprising a flange attached to the bottom open-end, the flange defining at least two bolt holes that are accessible beyond the periphery of the cylindrical portion;

providing flat LED boards, wherein each flat LED board:

comprises an illuminating surface and an attachment surface;

comprises a plurality of LED lights mounted for illumination on the illuminating surface; and is configured such that the attachment surface fits on one flat planar surface in the plurality of flat planar surfaces on the cylindrical portion;

providing a circular LED board comprising: a second illuminating surface; a second attachment surface; and a second plurality of LED lights mounted for illumination from the second illuminating surface, the circular LED board configured such that the attachment surface fits on the top open-end;

providing a turret connector board, the turret connector board:

comprising a plurality of electrical connection ports, where there is at least one electrical connection port for each flat LED board and for the circular LED board;

configured to electrically connect each flat LED board and the circular LED board in parallel when each flat LED board and the circular LED board are connected using the plurality of electrical connection ports; and is sized to fit within the chamber;

providing a driver circuit board electrically connected to the turret connector board;

connecting the circular LED board to the driver circuit board;

connecting the flat LED boards to the driver circuit board;

securing the circular LED board to the top open-end; and securing the flat LED boards to the plurality of flat planar surfaces such that there is one attachment surface for each flat planar surface in the plurality of flat planar surfaces.

2. The method of claim 1, further comprising the step of providing a top plate covering the top open-end, the top plate defining a wire-hole providing access to the chamber.

3. The method of claim 1, providing a mounting plate of heat conducting metal configured to couple the flange to a lamp fixture.

4. The method of claim 1, further comprising the steps of:

providing a top plate covering the top open end, the top plate defining a wire-hole providing access to the chamber applying thermal compound between each attachment surface and each flat planar surface; and applying thermal compound between the second attachment surface and the top plate.

5. The method of claim 1, further comprising the steps of:

providing a transparent cover configured to extend over the cylindrical portion and seal against the base portion, the transparent cover defining external threads extending adjacent to the flange up to the flat planar surfaces; and installing the transparent cover over the cylindrical portion.

6. The method of claim 1, further comprising the steps of:

providing a mount to backfit an incandescent lamp, the mount comprising an annular disk having a central hole surrounded by a right circular cylinder rising from the disk and defining an access opening at the top of the right circular cylinder, the access opening being of sufficient size to enable access to an incandescent socket placed within the right circular cylinder; and attaching the mount to the incandescent lamp so as to place the incandescent socket within the right circular cylinder.

7. A light emitting diode lamp made by the method of claim 1.

* * * * *